US008388816B2

(12) United States Patent
Martinez Gómez et al.

(10) Patent No.: US 8,388,816 B2
(45) Date of Patent: Mar. 5, 2013

(54) ANTI-VANDALISM BUNKER FOR CATHODIC PROTECTION RECTIFIERS

(75) Inventors: Lorenzo Martinez Gómez, Cuernavaca (MX); Lorenzo Martinez Martinez De La Escalara, Mexico City (MX); Jorge Joaquin Cantó Ibañez, Mexico City (MX)

(73) Assignee: Corrosion Y Proteccion Ingenieria, S.C., Colonia Vista Hermosa (MX)

( * ) Notice: Subject to any disclaimer, the term of this patent is extended or adjusted under 35 U.S.C. 154(b) by 315 days.

(21) Appl. No.: 12/626,725

(22) Filed: Nov. 27, 2009

(65) Prior Publication Data

US 2010/0270145 A1 Oct. 28, 2010

(51) Int. Cl.
*C23F 13/06* (2006.01)

(52) U.S. Cl. ..... 204/196.37; 204/196.1; 204/196.21; 204/196.36

(58) Field of Classification Search ..... 204/196.37, 204/196.1, 196.21, 196.36; 205/734
See application file for complete search history.

(56) References Cited

U.S. PATENT DOCUMENTS

2010/0037710 A1* 2/2010 Lavergne ..... 73/862.583

* cited by examiner

*Primary Examiner* — Bruce Bell
(74) *Attorney, Agent, or Firm* — Novak Druce Connolly Bove + Quigg LLP

(57) ABSTRACT

The invention consists of a bunker to visually hide and structurally protect a cathodic protection rectifier located in an open field or urban areas where there is high incidence of vandalism. The bunker consists of a mobile element which contains a rectifier and an underground cavity structure. Besides hiding and protecting the rectifier from vandalism, the only part of this apparatus that is normally visible is a circular plaque at ground level, with a waterproof seal. Occasionally the rectifier is removed for maintenance and diagnostic purposes. In order to extract the mobile element it is necessary, but not enough, to have a magnetic or electromagnetic anchor with a great load capacity. The mobile element may only be extracted when the bolt lock located at the base of the cylinder is wirelessly activated. The cavity structure has radial plates calculated to dissipate the heat produced through the operation of the rectifier. All electric connections are hidden and embedded in concrete. Apparatus are included for measuring the electric parameters relevant to the cathodic protection and a major vibration sensor for an alarm with the possibility of being connected to networks of control systems and data collecting or cellular or satellite networks.

6 Claims, 1 Drawing Sheet

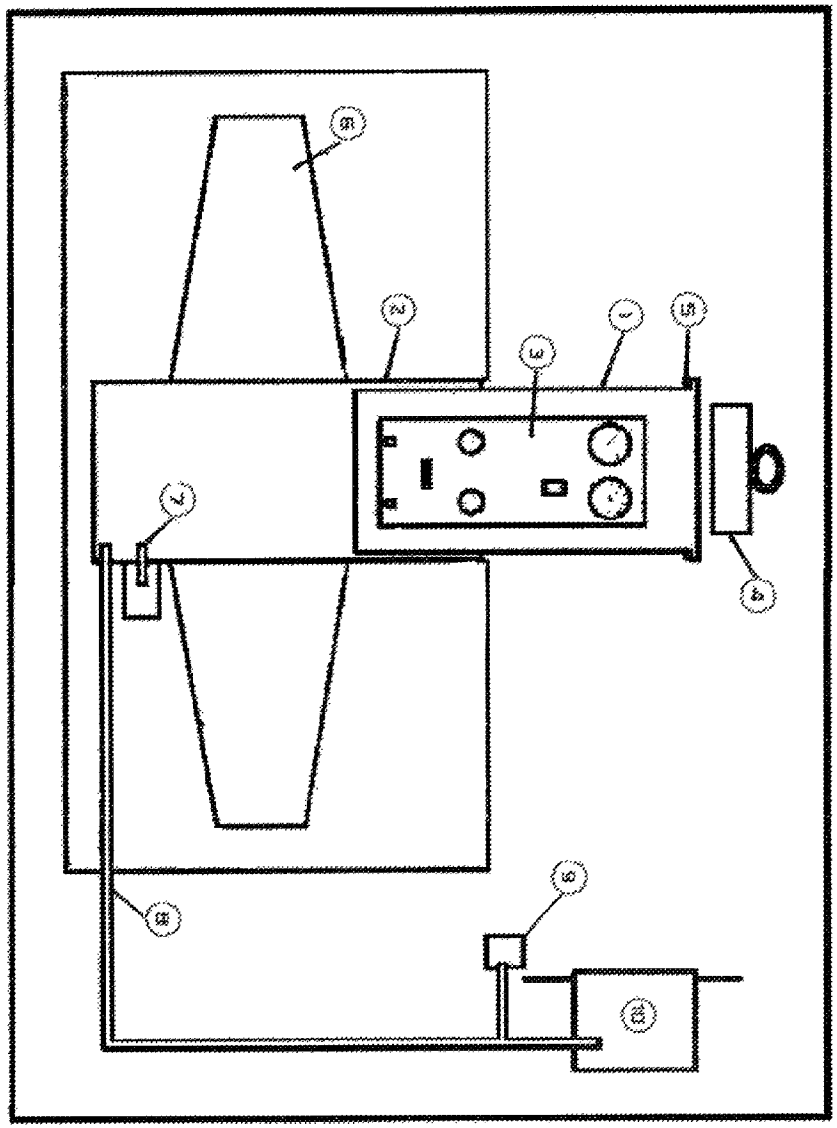
1
2
3
4
5
6
7
8
9
10

ANTI-VANDALISM BUNKER FOR CATHODIC PROTECTION RECTIFIERS

TECHNICAL FIELD

In general the invention refers to the design and construction of a bunker to protect a cathodic protection rectifier from vandalism. The bunker has been especially devised for the anti-vandalistic protection of a cathodic protection rectifier located in open fields in areas characterized by a high level of aggression, social resentment and vandalism; where there is a need to control exterior corrosion of the pipelines, tanks and other metallic structures by way of cathodic protection.

OBJECTIVE OF THE INVENTION

The objective of this invention is a bunker to visually hide; house and protect within a highly resistant structure; and expeditiously warn about damaging vandalistic actions to a cathodic protection rectifier. The bunker is built and located to be hidden from view, being located underground within a sealed steel and concrete structure reinforced with steel. The design takes into account elements for thermal dissipation of heat derived for the operation of the rectifier, a devise of magnetic anchorage, a bolt lock electromagnetic mechanism operated wirelessly and major vibration sensors.

BACKGROUND

Cathodic protection is the most widely accepted technology in the world for the protection from corrosion of pipelines, wells, tanks and other structures which are buried or submerged in corrosive electrolytes. There are national and international normative bodies which require production, storage and transportation operators of hydrocarbons through pipelines to apply systems which control exterior and interior corrosion, including predominantly cathodic protection.

An act of vandalism of cathodic protection rectifiers can cause irreparable damage which may lead to the total loss of the investment in the cost of purchase and installation. Besides the loss due to damage caused to the rectifier, the price of the interruption or intermittence of the cathodic protection to the structure must be considered, and this may lead to corrosion, accidents, leakage of valuable fluids, ecological damage and interruptions in service.

A search of open literature as well as that which refers to intellectual property did not reveal the existence of inventions related to the protection of cathodic protection rectifiers against vandalism. The search which was carried out only revealed the following:

In the state of the art there are only some apparatus designed to provide anti-vandalism protection for underground structures in places of public access, for example, a basin with a protective anti-vandalism top (ES1063394U), which protects vegetable matter or street furniture which may be inside it from theft or manipulation; however, there is no alarm system involved. We also found apparatus which protect artifacts located in public places, for example, an anti-vandalism hydrant (ES1030934U, ES1030935U), or public telephones (BRMU8103399U). These inventions are limited to very specific fields and the artifacts protected do not require additional functionality apart from the protective structure.

Patents for constructive schemes of a variety of configurations for systems of cathodic protection were also looked through (U.S. Pat. Nos. 4,515,669, 4,504,375, 6,193,443 B1, 6,461,082 B1, 4,089,767, 6,331,242 B1, 6,214,203 B1, 4,175,021, 6,744,265 B2, 3,868,313, 4,169,028, and 5,305, 631). In none of these was reference or consideration found related to the social phenomenon of vandalism, nor were constructive elements found which could be thought to be similar to those described in the patent which we will now describe.

In pertinent literature we found that patent application MX/a/2008/011513 partially defends a system for cathodic protection from vandalism attacks; however this patent application does not protect the active element of this system. The latter, the rectifier, is the objective to be protected by the present invention since it represents the highest cost and most frequent objective of attacks.

This invention simultaneously provides a solution to the cathodic protection of the buried structure, as well as protecting the active element which is most vandalized in this type of systems; the rectifier. Thus, not only is the investment in the cathodic protection covered, but also, the investment in the protective system, since there is a possibility for uninterrupted cathodic structural protection, thus prolonging the lifetime of the buried structure, the final objective of the cathodic system.

DETAILED DESCRIPTION OF THE INVENTION

The anti-vandalism bunker made of reinforced concrete for cathodic protection rectifiers consists of two basic elements which are shown in FIG. 1. The invention consists of a bunker to visually hide and structurally protect a cathodic protection rectifier located in an open field or urban areas where there is high incidence of vandalism. The basic elements are: a mobile element (1) which contains a rectifier (3) and an underground cavity structure (2).

The mobile element is cylindrical or parallelepiped in shape, made of steel on which are mounted the components of the cathodic protection rectifier. The components of the rectifier which will be placed inside the mobile element are usually the power transformation unit, the voltmeter and electric current meter, fuses, possible automation systems, entrances for feed wires for alternating current, the exit for the direct current wires, accessory elements for the rectifier.

The steel cavity structure embedded in a mass of high-strength reinforced concrete to protect against vandalism is located below the surface of the ground with a capacity to house the mobile element referred to previously. The cavity structure also houses and hides the electrical feeding for the rectifier, a bolt lock (7) also hidden from view. The cavity structure has radial plates (6) with large surface area to dissipate the heat produced from the operation of the rectifier into the ground. The number and distribution of these plates depends on the necessities of the ground and the size of the structure to be protected.

The dimensions of the mobile element and the cavity structure will vary depending on the size of the rectifier in a range of from 30 cm to 100 cm in diameter or diagonally in a cross section, a length of between 60 cm and 120 cm.

All of the structure previously described under normal conditions is below the surface of the ground, sealed with a ring seal (5) which prevents fluids from flowing into the bunker. The main characteristic of this ring seal is that it does not have any protuberances which allow for prying the top off. The ring seal does not have any place to insert a wedge, level, hook or any other action which employs typical tols available to vandals.

Since the seal ring is practically unmovable, a magnetic or electromagnetic anchoring device (4) is used to grasp the seal ring together with the mobile element and extract it once the bolt lock element has been freed by sending a signal to its antenna. Given the combined weight of the rectifier and the mobile element, it is necessary to use a crane or winch for this last operation.

The power supply (8) for the rectifier as indicated in FIG. 1, is installed below the earth's surface and enters the cavity on the under side. The electrical connections with the anodic bed, the pipelines or structures to be protected, the referenced cell and other relevant elements, antennas or sensors are also connected to the rectifier on the under side.

The invention also consists of a cavity (9) to house the antenna of the bolt lock and a vibration sensor with an optional exit for acoustic alarms and communication systems.

Since it is necessary to monitor and calibrate the functioning of the rectifier, there is a housing for voltage and electric current meters (10).

The operative characteristics of the bunker for the rectifier are the following:

1. Normally the mobile element, and thus the rectifier, are housed inside the cavity structure with no visual attraction since they are hidden from view, underground. The mobile element shows only a ring seal as a simple top at ground level, eliminating visual attraction for vandals.

2. The measurements of the main parameters of operation and maintenance of the rectifier are carried out in a measurement housing located on the side of the bunker. Parameters which may be measured in the mechanism are: output voltage and direct current, input voltage and alternate current.

3. For more detailed monitoring, maintenance and repairs of the cathodic protection rectifier, the mobile element may be slid fully upwards. In order to carry out this action, the following procedure is used:

The bolt lock is activated by means of the antenna or external apparatus in order to be placed in the open position.

The magnetic or electromagnetic anchoring device is placed on top of the metallic top of the mobile element.

A hook on a cable is placed on the magnetic anchoring devise and it is raised with a pulley, crane or winch. This action slides the mobile unit upwards until the controls of the rectifier are within reach of the operator of the cathodic protection. The operator has the option of inspecting the state of the rectifier; carrying out minor repairs such as changing diodes, fuses, connections and other similar actions; and if need be, disconnecting and removing the mobile element completely in order to take it to a workshop for major maintenance.

After the operations of inspection and maintenance of the rectifier, the mobile element is placed over the cavity structure and slid downwards until the top is at ground level. Subsequently the bolt lock is closed by means of the antenna.

Finally the magnetic anchoring device is removed.

The vibration sensor detects intents to open the bunker and may send alarm signals.

DESCRIPTION OF THE DRAWINGS

FIG. 1 represents a cross section of the bunker, where the elements which make it up may be observed. These elements are (1) the mobile element which houses the rectifier and of which only the top at ground level is visible from outside, (2) the Cavity structure of reinforced concrete where the mobile element is housed, (3) the Rectifier, (4) the Magnetic or electromagnetic anchoring devise, (5) the Ring seal which prevents liquids and dust from entering the bunker, (6) Thermal dissipation plates designed ad-hoc depending on the load each system is to protect, (7) the Bolt lock which is activated wirelessly, (8) the Tubes which house the feeding cables for direct current to the anodic bed, structure and sensors, (9) Major vibration sensors and bolt lock antenna, (10) Housing for measurement of voltage and currents.

The invention claimed is:

1. A housing structure configured to provide an uninterrupted protection of a cathodic rectifier and accessory elements of the cathodic rectifier, containing, over at least a single radial plate surface inside the housing structure, a cylindrical mobile unit to prevent interruptions and manipulations related with vandalism, the cathodic rectifier housing structure also comprising:

a ring seal to prevent fluids and dust from entering into the housing;

an acoustic alarm system including sensors to detect vibrations;

an electromagnetic anchorage device located at the upper end of the top of the mobile unit to pull upwards the mobile unit out of the housing structure after activating a bolt lock, wherein the bolt lock electromagnetic mechanism grasped to the mobile unit and linked to an antenna to remotely activate the mechanism by freely removing or securing the ring seal;

wherein the mobile unit is over at least a single radial plate surface dimensionally configured to dissipate heat from the cathodic rectifier throughout the housing;

wherein the mobile unit at least comprises:

automation systems for the cathodic rectifier, electric current meters, fuses, a voltmeter, a power transformation unit, a first cavity located in an underside end to allow the entrance of feed cable tubes for a power supply electrical feed of alternating current for the cathodic rectifier, and a second cavity located in an underside end to allow the exit of cable tubes for the acoustic alarm and for electrical communication of direct current from the cathodic rectifier, at least with an anode bed, referenced cells, an antenna for the bolt lock, and with at least a single metallic structure to be protected with said cathodic protection of the group comprising pipelines, tanks, and wells.

2. A housing structure of claim 1 characterized by having a steel cavity structure sunk in a mass of reinforced concrete highly resistant to acts of vandalism which is located below the surface of the ground with a capacity for holding the mobile element.

3. A housing structure of claim 1 wherein the ring seal does not have any place to insert a wedge, lever, hook or any other action which employs typical tools available to vandals.

4. A housing structure of claim 1 characterized by having the bolt lock mechanism activated wirelessly and located at a depth which is out of visual as well as physical reach of perpetrators of vandalism.

5. The housing structure of claim 1 which is reinforced concrete.

6. The housing structure of claim 5 wherein said mobile unit is steel.

* * * * *